US007549685B2

(12) United States Patent
Mueller et al.

(10) Patent No.: US 7,549,685 B2
(45) Date of Patent: Jun. 23, 2009

(54) LOCK FOR A HOUSEHOLD APPLIANCE

(75) Inventors: Heinrich Mueller, Tuttlingen (DE); Manfred Lonau, Rietheim-Weilheim (DE)

(73) Assignee: Marquardt GmbH, Rietheim-Weilheim (DE)

( * ) Notice: Subject to any disclaimer, the term of this patent is extended or adjusted under 35 U.S.C. 154(b) by 0 days.

(21) Appl. No.: 11/553,128

(22) Filed: Oct. 26, 2006

(65) Prior Publication Data

US 2007/0108777 A1 May 17, 2007

Related U.S. Application Data

(63) Continuation of application No. PCT/EP2005/004426, filed on Apr. 26, 2005.

(30) Foreign Application Priority Data

Apr. 27, 2004 (DE) ..... 10 2004 020 444

(51) Int. Cl.
*E05C 17/56* (2006.01)

(52) U.S. Cl. ..... 292/251.5; 335/186; 292/DIG. 69

(58) Field of Classification Search ..... 292/251.5, 292/144, DIG. 69; 335/186; 126/191, 197
See application file for complete search history.

(56) References Cited

U.S. PATENT DOCUMENTS

| | | | | |
|---|---|---|---|---|
| 4,314,217 | A * | 2/1982 | Krasser | 335/188 |
| 4,932,707 | A | 6/1990 | Ekstran | |
| 5,520,424 | A * | 5/1996 | Hapke et al. | 292/198 |
| 5,879,036 | A * | 3/1999 | Moline et al. | 292/210 |
| 6,053,546 | A * | 4/2000 | Frolov | 292/251.5 |
| 6,334,637 | B1 | 1/2002 | Chioffi | |
| 6,363,755 | B1 * | 4/2002 | Hapke et al. | 68/12.26 |
| 6,603,377 | B2 * | 8/2003 | Cho et al. | 335/186 |
| 2002/0017793 | A1 * | 2/2002 | Spiessl | 292/341.16 |
| 2003/0197387 | A1 * | 10/2003 | Dirnberger | 292/216 |
| 2006/0145485 | A1 * | 7/2006 | Hapke | 292/251.5 |

FOREIGN PATENT DOCUMENTS

| | | | |
|---|---|---|---|
| DE | 40 34 853 | A1 | 5/1992 |
| DE | 198 34 844 | A1 | 10/1999 |
| DE | 199 61 083 | A1 | 6/2000 |
| EP | 0 359 728 | A2 | 3/1990 |
| EP | 0 483 697 | A1 | 5/1992 |
| GB | 1178291 | A1 | 1/1970 |

* cited by examiner

*Primary Examiner*—Patricia L Engle
*Assistant Examiner*—Kristina R Fulton
(74) *Attorney, Agent, or Firm*—Burr & Brown

(57) ABSTRACT

A lock for a household appliance, such as a tumble drier, a washing machine, a dishwasher or the like, has a movable retaining element. The movable retaining element is configured in the style of a slider for interaction with a locking bar located on a door, a lid, a hinged opening or the like of the household appliance. The lock has a two-state locking mechanism for the retaining element, such that the locking mechanism in a first state blocks the movement of the retaining element and in a second state frees the movement of the retaining element. The locking mechanism can be electromagnetically controlled between the two states.

18 Claims, 11 Drawing Sheets

LOCK FOR A HOUSEHOLD APPLIANCE

CROSS REFERENCE TO RELATED APPLICATIONS

This application is a continuation of International Application No. PCT/EP2005/004426 having a filing date of Apr. 26, 2005, which designated the United States, and claims the benefit under 35 USC §119(a)-(d) of German Application No. 10 2004 020 444.6, filed Apr. 27, 2004, the entireties of which are incorporated herein by reference.

FIELD OF THE INVENTION

The invention relates to a lock for a household appliance.

BACKGROUND OF THE INVENTION

Household appliances, such as a tumble drier, a washing machine, a dishwasher or the like, possess a door, a lid, a hinged opening or the like to allow loading and/or unloading. The door, the lid, the hinged opening or the like, hereinafter also referred to as the closing element, are provided with a lock.

A lock of this type has a retaining element, configured, for example, in the style of a slider, for interaction with a locking bar located on the closing element of the household appliance. The lock further possesses a two-state locking mechanism for the retaining element, such that the locking mechanism in a first state blocks the movement of the retaining element and in a second state frees the movement of the retaining element.

Such a lock is known from DE 199 61 083 A1, in which the locking mechanism is mechanically controlled between the two states with a pawl drive. This mechanical control system is disadvantageously complex and prone to faults.

SUMMARY OF THE INVENTION

The object of the invention is to refine the lock and locking mechanism to reduce or eliminate faults.

In the lock according to the invention, the locking mechanism can be electromagnetically controlled between the two states.

For the direct electromagnetic control of the locking mechanism, i.e. dispensing with further complex mechanics, an electrically energizable coil can be used. This coil can be constituted, once again, by an electromagnet.

In a first, very simple embodiment, the locking mechanism has a movable blocking element, the blocking element, at one end, in the first state being in interaction with the retaining element and in the second state being free from interaction with the retaining element. At the other end of the blocking element there is disposed a permanent magnet. The permanent magnet interacts with the electromagnet in such a way that, by appropriate energization of the electromagnet, the permanent magnet is attracted or repelled effecting the movement of the blocking element between the two states.

In a second, likewise very simple embodiment, the locking mechanism has, once again, a movable blocking element. The blocking element, at its one end, in the first state is in interaction with the retaining element and in the second state is free from interaction with the retaining element. At the other end of the blocking element, a rocker element, switchable between two settings, is operatively connected to the electromagnet. The operative connection is established by means of a push rod movable by the electromagnet. The push rod engages for switching purposes in a connecting link of, for example, an approximately W-shaped configuration on the rocker element.

The first and the second embodiments can be built in a very compact construction, in particular by the blocking element being pivotably configured.

The lock can be appropriately controlled by a control system in the household appliance. For example, the control system can free the manual opening of the closing element only once the household appliance has finished running. This can be catered for by a switching element being operatively connected to the retaining element and/or the locking mechanism, such that the switching element generates switching signals as a function of the setting of the retaining element and/or the locking mechanism. These switching signals are then, in turn, used by the control system in the household appliance for the appropriate controlling of the lock.

In general, the closing element is movable between a closed setting and an open setting, i.e. the door on the washing machine can be opened or closed, for example. The traditional procedure in this case is that an electric switch, serving as a door contact, interacts with the closing element to recognize the closed and/or the open setting. This electric switch can be disposed, for example, on the body of the household appliance.

With the aid of the invention, the electric switch serving as a door contact can be wired particularly easily. In this case, the electric switch is connected in series with a connection for the supply voltage of the coil, i.e. for the electromagnet for actuating the locking mechanism. The electric switch is then turned on whenever the closing element is in the closed setting, whereby the supply voltage for actuating the coil is present. The coil can then, where necessary, be actuated by the control system of the household appliance, by means of an auxiliary contact. Advantageously, in such a circuit arrangement, only a three-pole electrical connection for the coil, the door contact and the auxiliary contact device is required, whereas traditionally a four-pole or five-pole electrical connection is provided for this purpose.

The benefits obtained with the invention consist particularly in the fact that the locking mechanism can be easily controlled between the two states in an automated manner. The lock, moreover, despite high functionality, is inexpensive and is thus particularly well suited to cost-sensitive household appliances. The directly controlled electromagnetic locking mechanism is very reliable and can thus be used in the household appliance even in safety-critical applications. Moreover, a lock, which is configured in such a way, is compactly built and is thus suitable for cramped installation spaces in household appliances.

BRIEF DESCRIPTION OF THE DRAWINGS

Illustrative embodiments of the invention having different refinements and embodiments are represented in the drawings and are described in greater detail below.

DETAILED DESCRIPTION OF THE INVENTION

Figure 10:
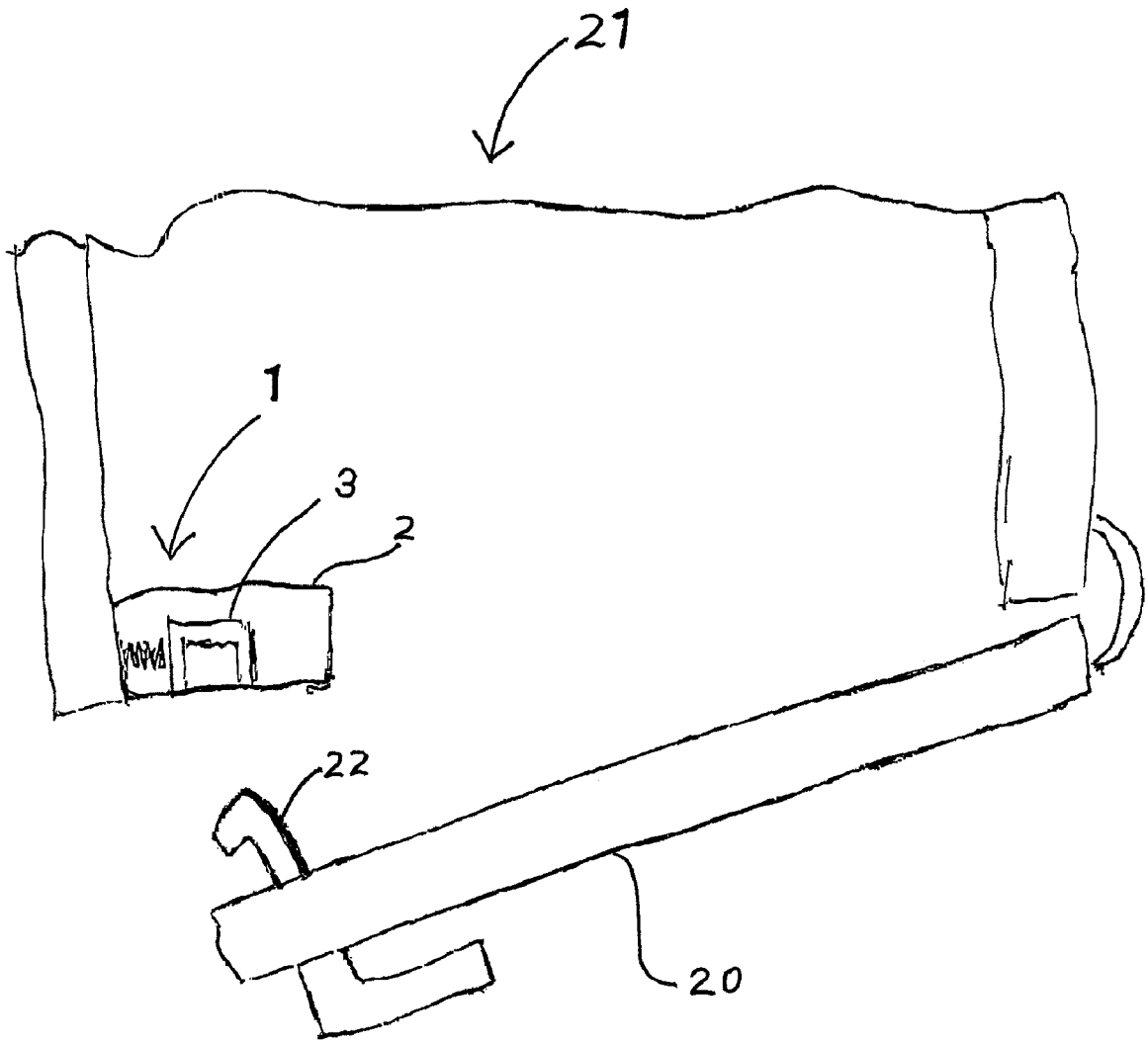
FIG. 10 shows a lock according to an illustrative embodiment being mounted to a household appliance.

A lock 1 for a door, a lid, a hinged opening or some other moving part as a closing element, hereinafter denoted purely for simplification purposes by "door" 20, on a household appliance 21, such as on a tumble drier, on a washing machine, on a dishwasher or the like, can be seen in FIG. 10. The lock 1 possesses a housing 2, in which a retaining element 3, which in the present case is configured in the style of a slider, is movably mounted. The retaining element 3 interacts with a locking bar 22 for closing the door. The locking bar 22 is located on the door 20 of the household appliance 21 and, on a bottom side of the lock 1 (concealed in FIG. 1), engages in a recess 16 on the retaining element 3.

Figure 11A:
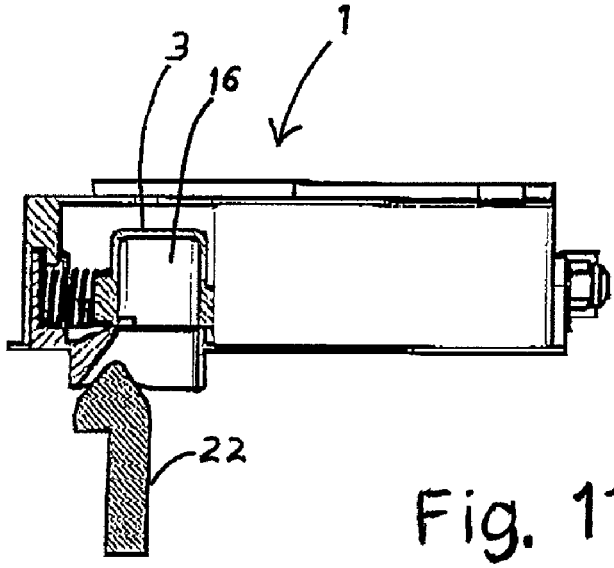
FIGS. 11*a* to 11*c* show a partial section of the lock of FIG. 10, demonstrating the motional sequence for closing and locking a door on the household appliance.
Figure 11B:
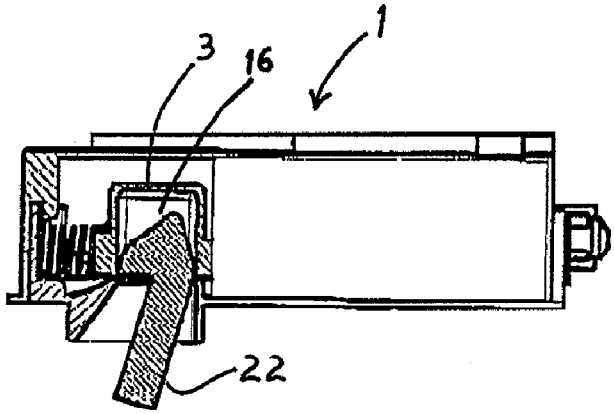
Figure 11C:
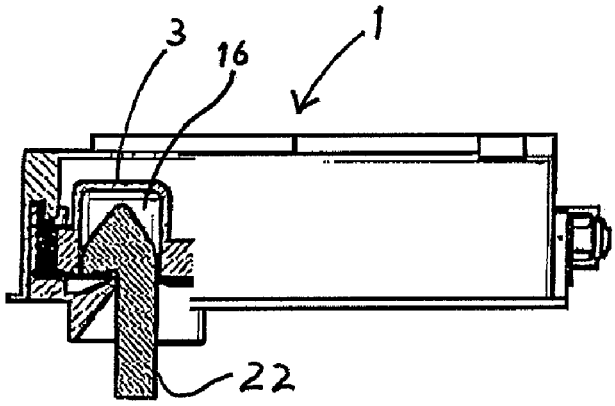

FIGS. 11*a*-11*c* show a motional sequence of closing the door 20 on the household appliance 21 such that the locking bar 22 is accepted into the recess 16 of retaining element 3. In FIGS. 11*a* and 11*b*, the retaining element 3 of the lock 1 is in an open position allowing the retaining element 3 to move freely such that the door 20 can be opened and closed. In FIG. 11*c*, the retaining element 3 of the lock 1 is blocked such that the door 20 is locked in the closed position.

Figure 1:
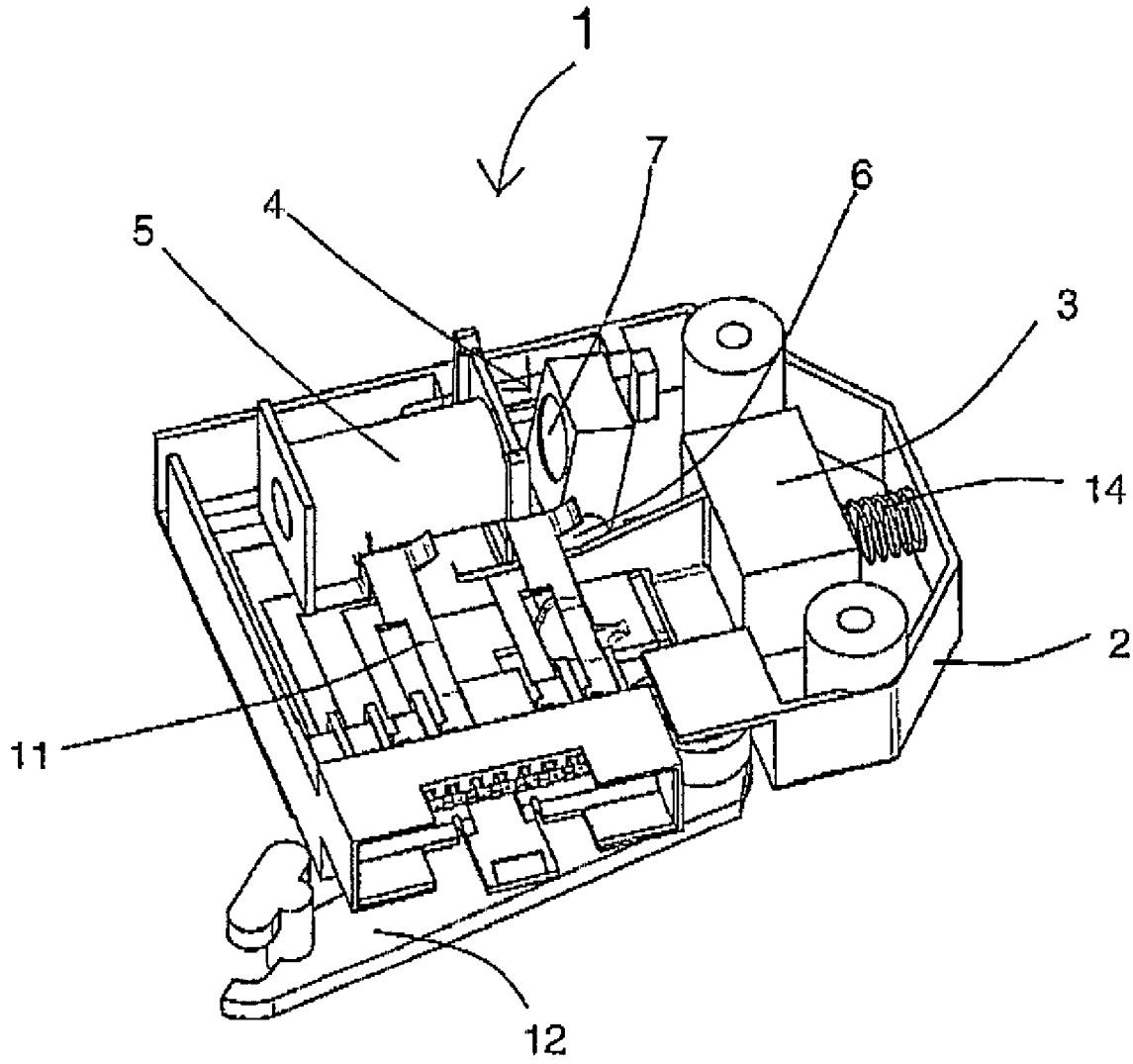
FIG. 1 shows a lock in perspective view according to a first illustrative embodiment.

In the housing 2 of the first illustrative embodiment shown in FIG. 1, there is found a two-state locking mechanism 4 for the retaining element 3, such that the locking mechanism 4 in a first state blocks the movement of the retaining element 3 and in a second state frees the movement of the retaining element 3. The locking mechanism 4 can be directly electromagnetically controlled between the two states, for which purpose a coil in the style of an electromagnet 5, which is electrically energizable, is disposed in the housing 2.

The locking mechanism 4 has a movable blocking element 6, which in the present case is pivotably configured. One end of the blocking element 6 in the first state is in interaction with the retaining element 3 and in the second state is free from interaction with the retaining element 3. According to a first illustrative embodiment which can be seen in FIG. 1, at the other end of the blocking element 6 there is disposed a permanent magnet 7. The permanent magnet 7 interacts with the electromagnet 5 such that, by appropriate energization of the electromagnet 5, the permanent magnet 7 is attracted and/or repelled for the movement of the blocking element 6 between the two states. Finally, the lock 1 according to FIG. 1 further possesses a pivotable emergency unlocking lever 12, by which the locking mechanism 4 can be brought manually into the second state in the event of a power failure.

Figure 2:
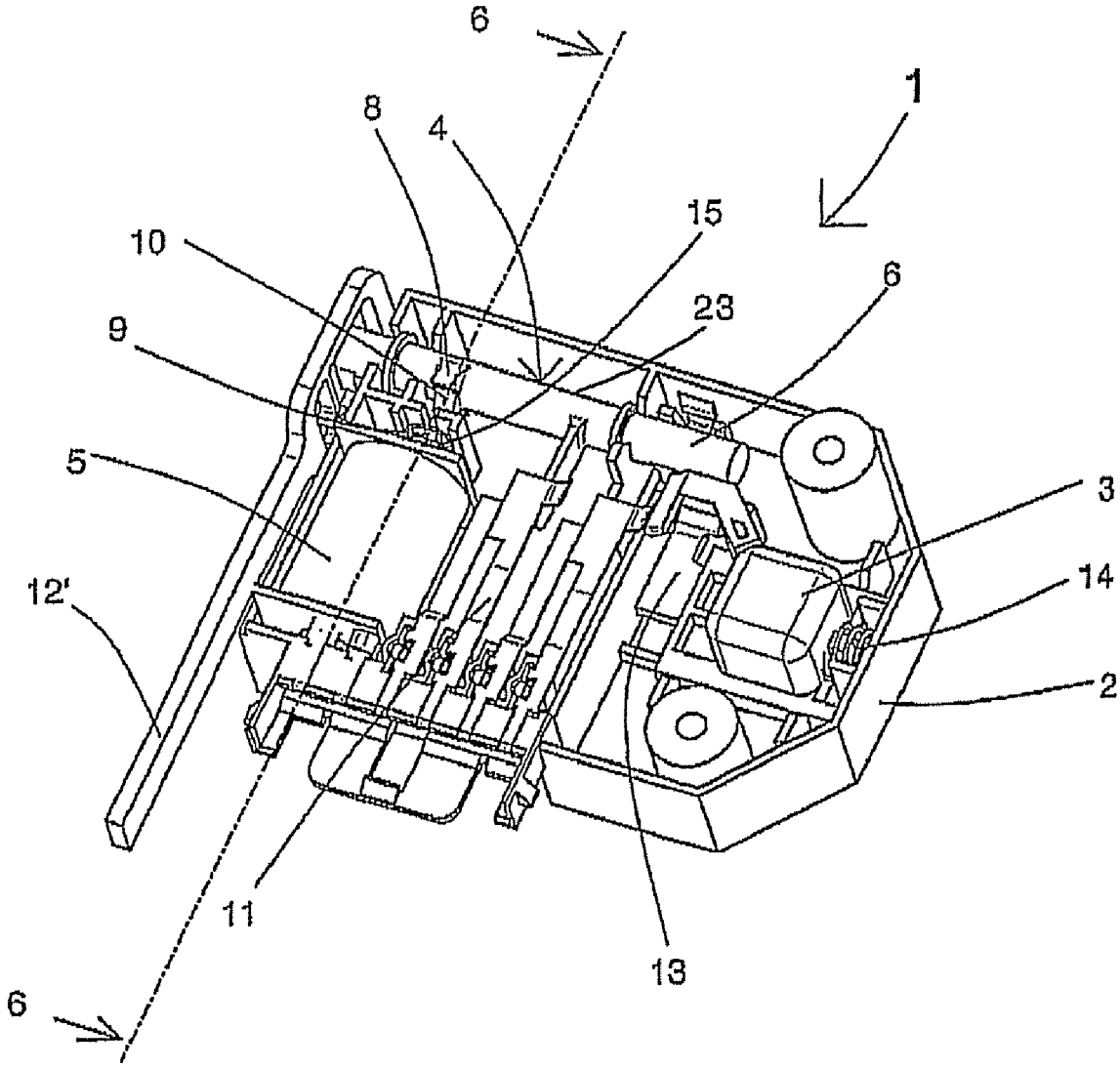
FIG. 2 shows a lock in a perspective view according to a second illustrative embodiment, the locking mechanism being in the first state.
Figure 3:
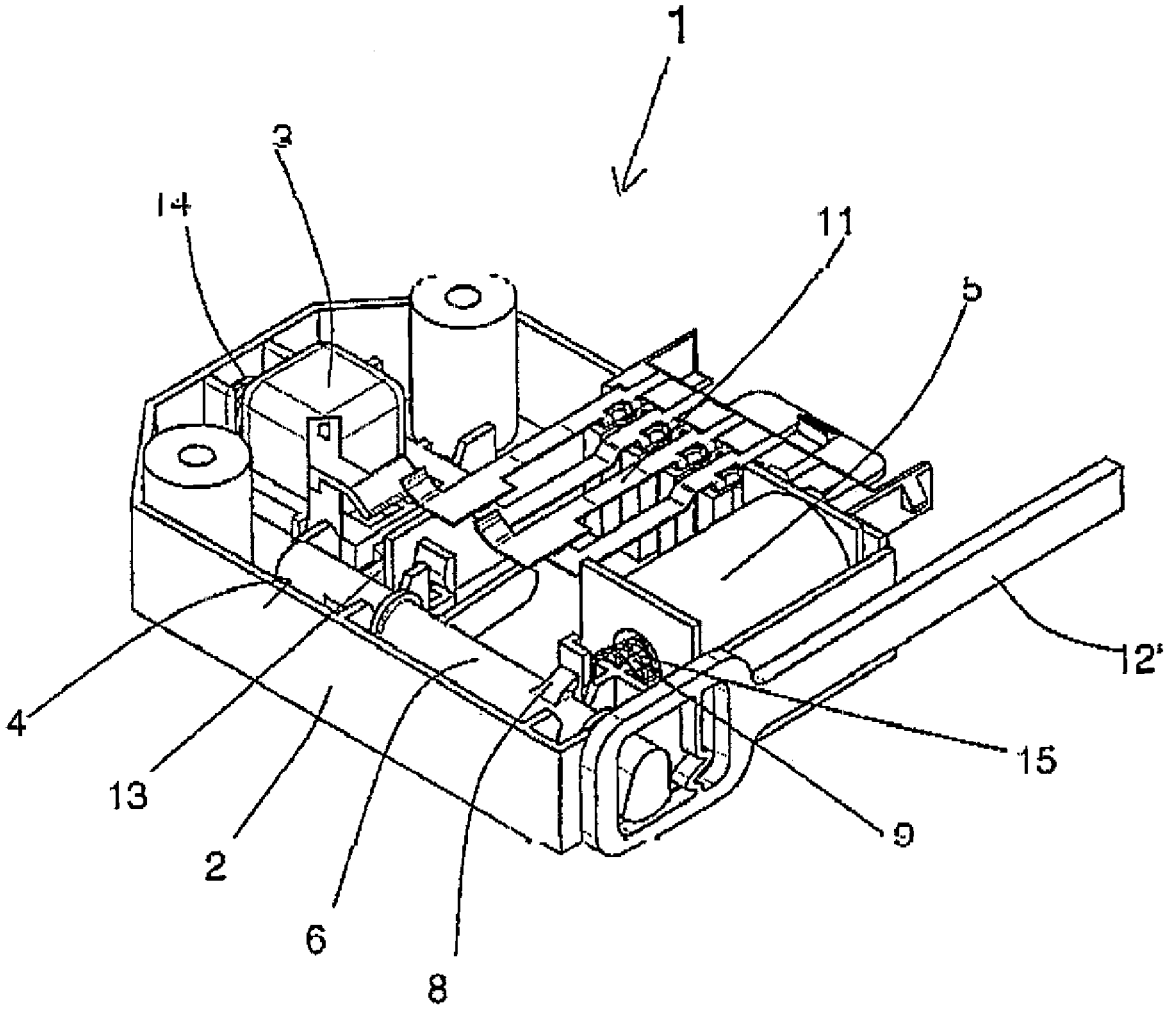
FIG. 3 shows the lock from FIG. 2 in another perspective view, the locking mechanism being in the first state.

A lock 1 according to a second illustrative embodiment can be seen in FIG. 2. The pivotable blocking element 6 of the locking mechanism 4 possesses, in particular at one end, a blocking surface 13, which in the first state bears against the retaining element 3. As can be seen from FIGS. 2 and 3, the movement of the retaining element 3 against a spring 14 is blocked, with the result that the door cannot be opened. On the blocking element 6, particularly at its other end, there is found a rocker element 8, which can switch between two states, which is attached to the blocking element 6 and is operatively connected to the electromagnet 5. As shown in FIG. 2, for example, the blocking element 6 and the rocker element 8 are connected to and separated from one another by a cylindrical portion 23. The operative connection to the rocker element 8 is established by means of a push rod 9 movable by the electromagnet 5, the push rod 9 engaging for switching purposes in a connecting link 10 of an approximately W-shaped configuration on the rocker element 8, as can be discerned with reference to FIG. 6*a*.

Figure 4:
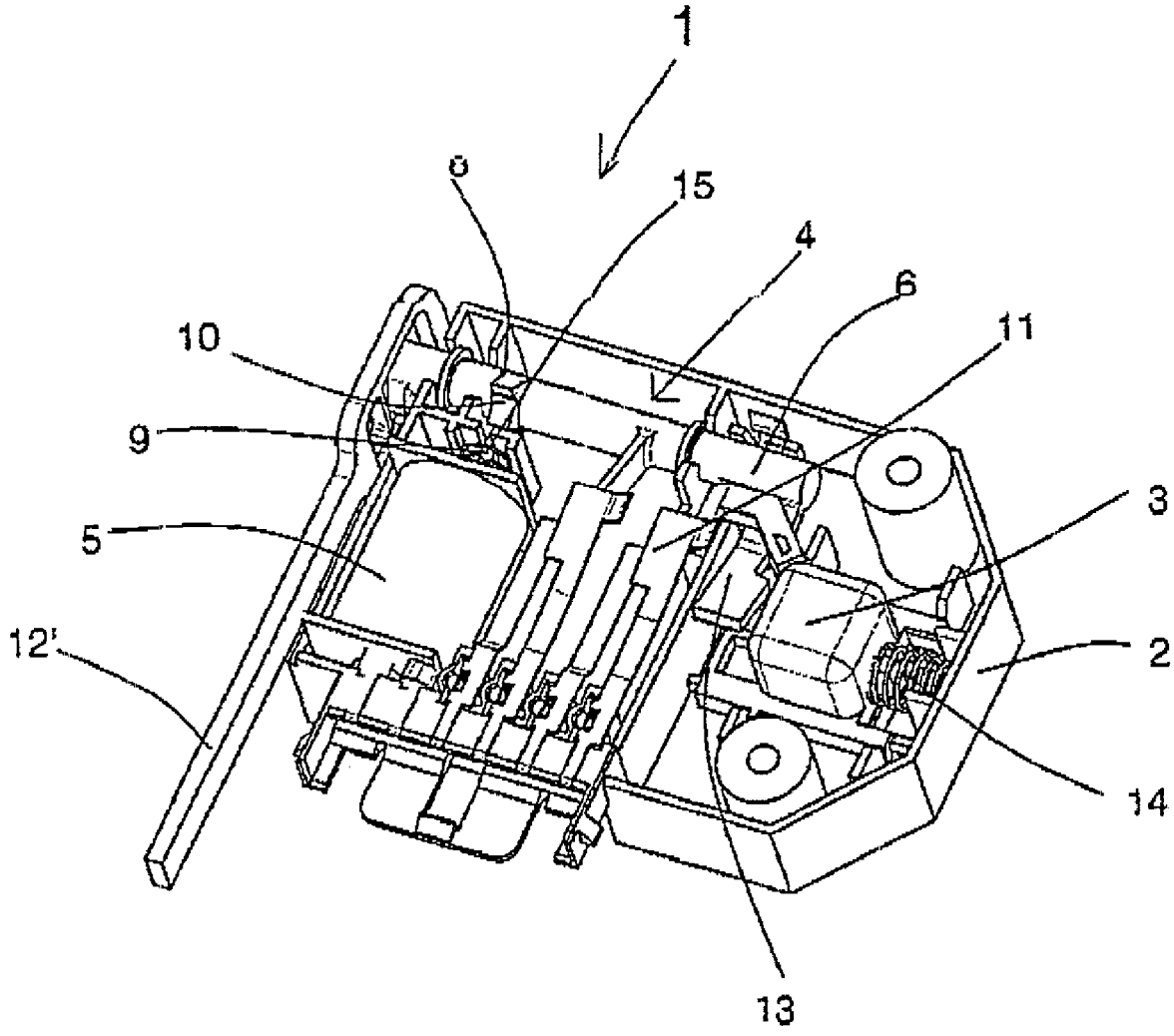
FIG. 4 shows the lock as in FIG. 2, the locking mechanism being in the second state.
Figure 5:
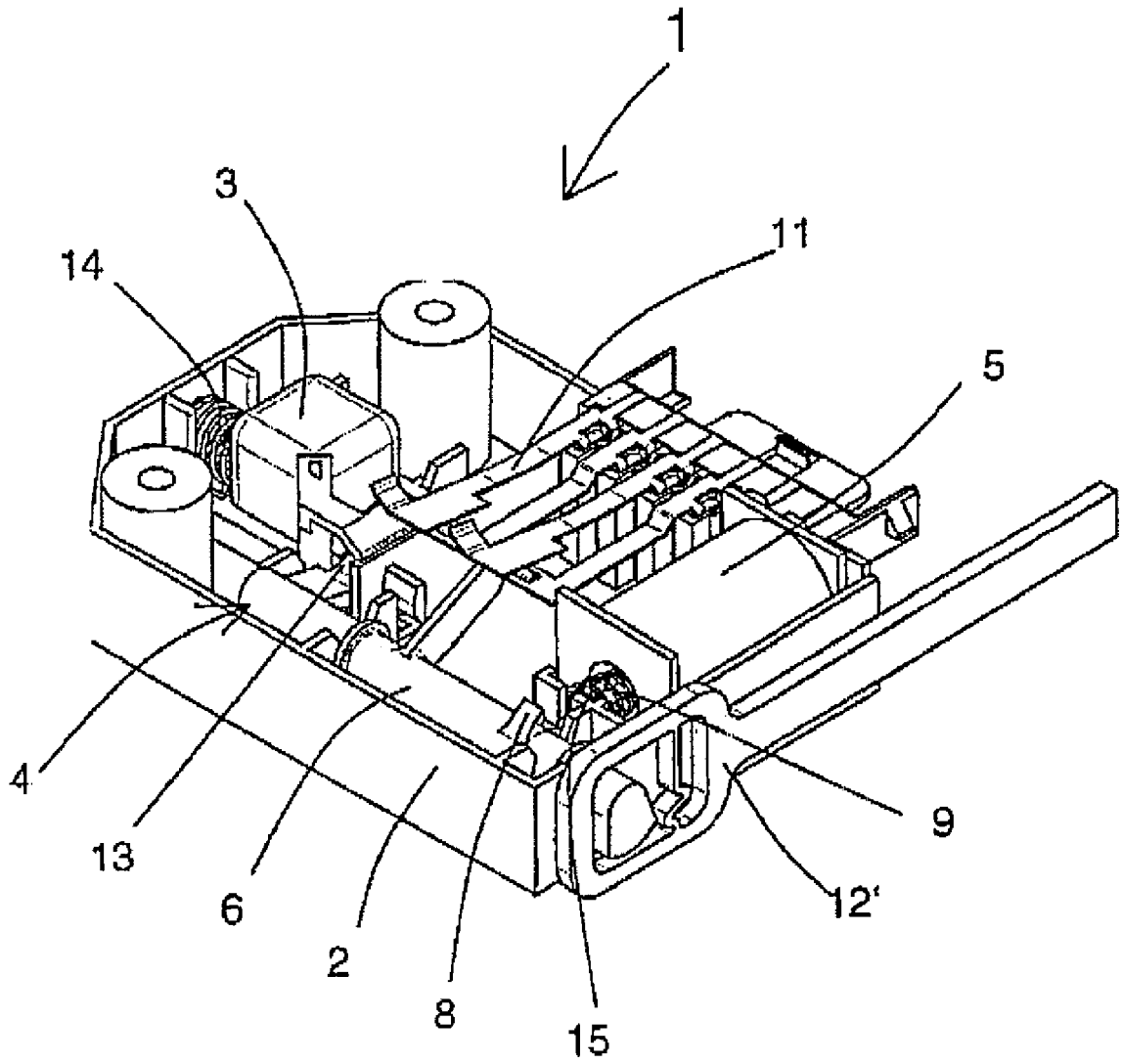
FIG. 5 shows the lock as in FIG. 3, the locking mechanism being in the second state.

By energization of the electromagnet 5, the rocker element 8 is switched over and the locking mechanism 4 is hereupon brought into the second state. As can be seen from FIGS. 4 and 5, in the second state the blocking surface 13 no longer bears against the retaining element 3. The movement of the retaining element 3 against the spring 14 is thus freed, with the result that the door can be opened. In this embodiment of the lock 1, the emergency unlocking lever 12' is displaceably configured.

Figure 6A:
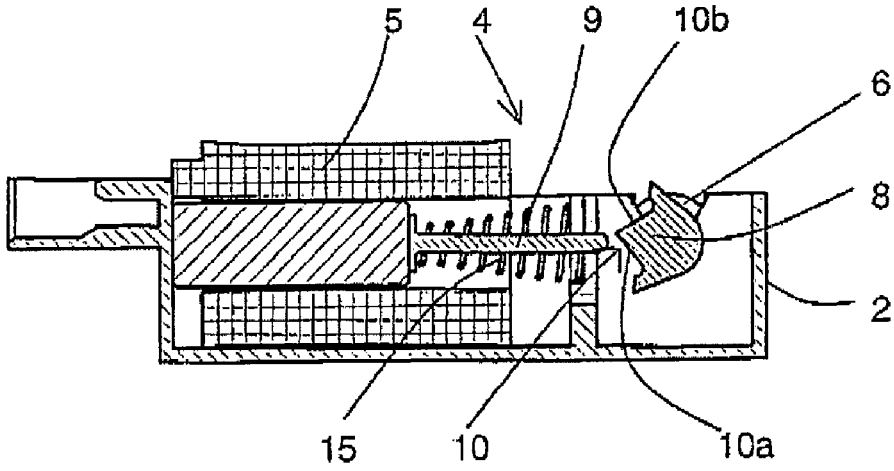
FIGS. 6*a* to 6*c* show a section along the line 6-6 from FIG. 2, the motional sequence for the switching of the locking mechanism being represented.
Figure 6B:
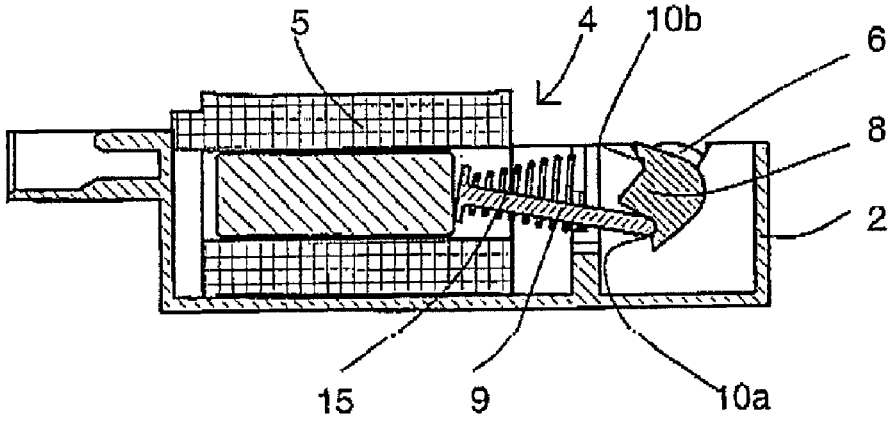
Figure 6C:
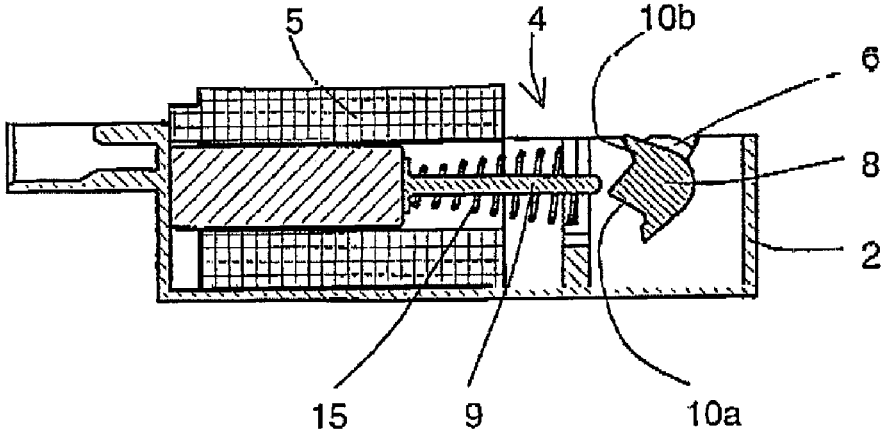

The switching operation of the rocker element 8 is represented in greater detail in FIGS. 6*a* to 6*c*. In FIG. 6*a*, the locking mechanism 4 is in the second state, so that the blocking element 6 frees the movement of the retaining element 3. The push rod 9 here lies opposite one connecting link part 10*a* of the connecting link 10. If the electromagnet 5 is energized, then the push rod 9 is moved into the connecting link part 10*a* and hereupon turns the rocker element 8, as can be seen from FIG. 6*b*. At the same time, the blocking element 6 is thereby pivoted into the first state of the locking mechanism 4, which state blocks the retaining element 3. Once the energization has ended, the push rod 9, due to the compression spring 15, reverts to its original position, shown in FIG. 6*c*. There, the push rod 9 now lies opposite the other connecting link part 10*b*. The rocker element 8, together with the blocking element 6, remains in this state until such time as the electromagnet 5 is energized once again. If the electromagnet 5 is energized, the push rod 9 then moves into the connecting link part 10*b* and switches back the rocker element 8, so that the second state of the locking mechanism 4 shown in FIG. 6*a* is once again adopted.

In order to monitor the state in which the lock 1 is found, a switching element 11 visible in FIG. 1 or FIG. 2 is disposed in the housing 2. The switching element 11 is operatively connected to the retaining element 3 and/or the locking mechanism 4, such that the switching element 11 generates switching signals as a function of the setting of the retaining element 3 and/or the locking mechanism 4, which switching signals are used by an machine control system in the household appliance for the appropriate controlling of the electromagnet 5 in the lock 1.

The door is fastened to the body of the household appliance in a known manner by means of a hinge and can be moved manually by the user between a closed setting and an open setting. If, however, the locking mechanism 4 is in the first state and the door is closed, then the door cannot be opened. Only in the second state of the locking mechanism 4 is an opening of the door possible. The respective setting of the door is detected also in a known manner by means of an electric switch, serving as a door contact, disposed on the body of the household appliance, by the door interacting with the door contact in order to recognize the closed and/or the open setting.

Figure 7:
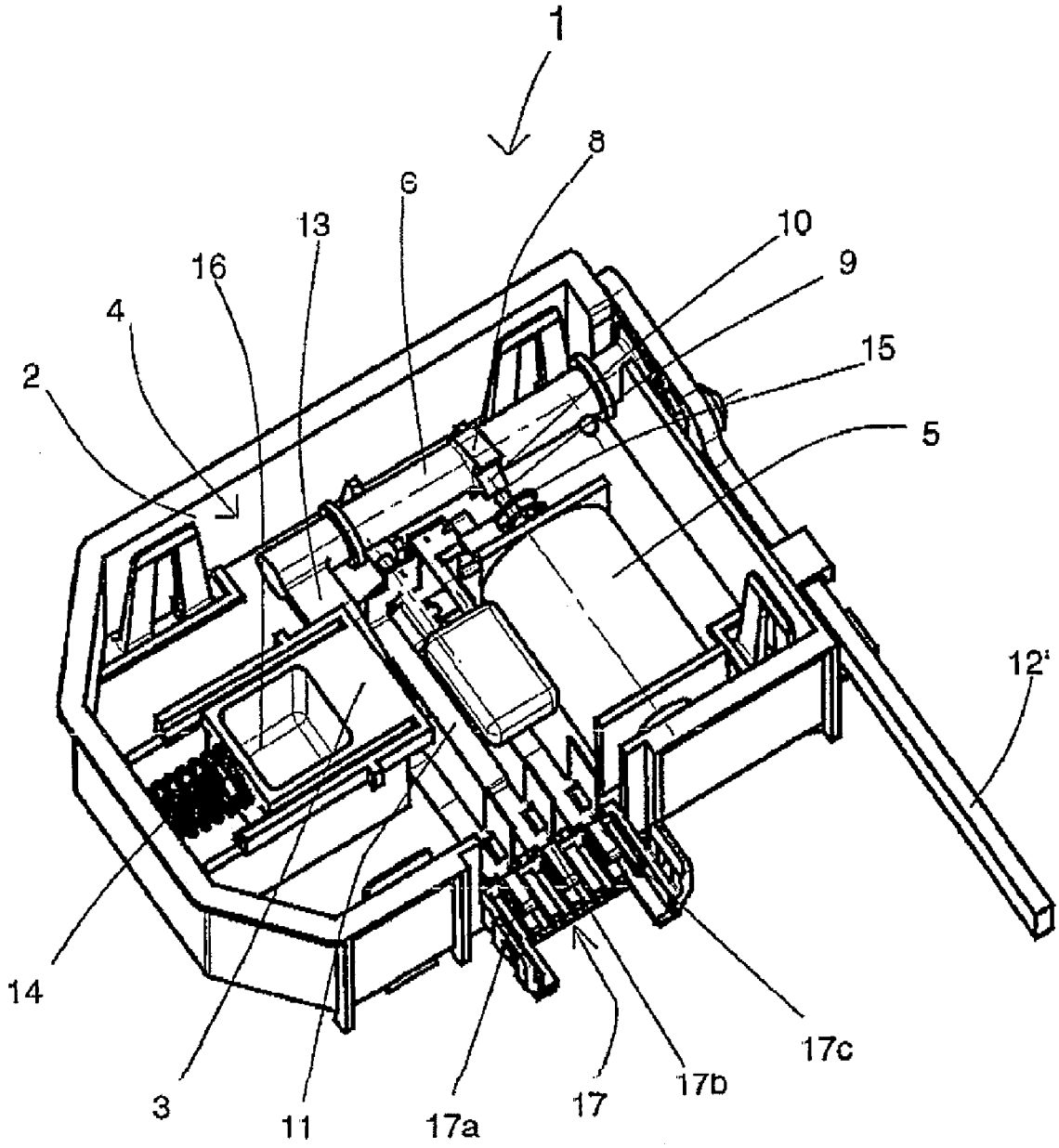
FIG. 7 shows a lock in a first perspective view according to yet another illustrative embodiment.
Figure 8:
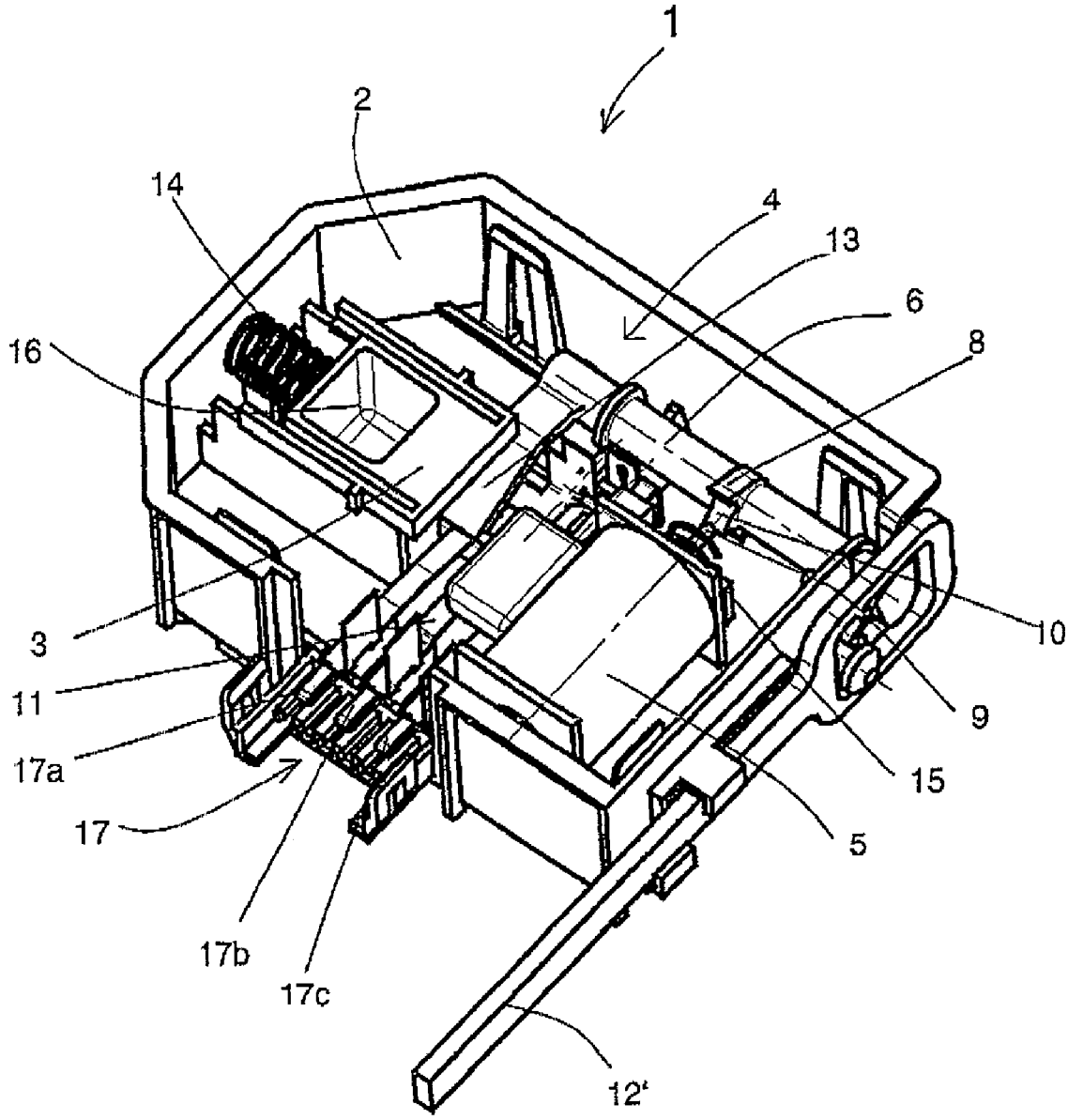
FIG. 8 shows the lock from FIG. 7 in a second perspective view.
Figure 9:
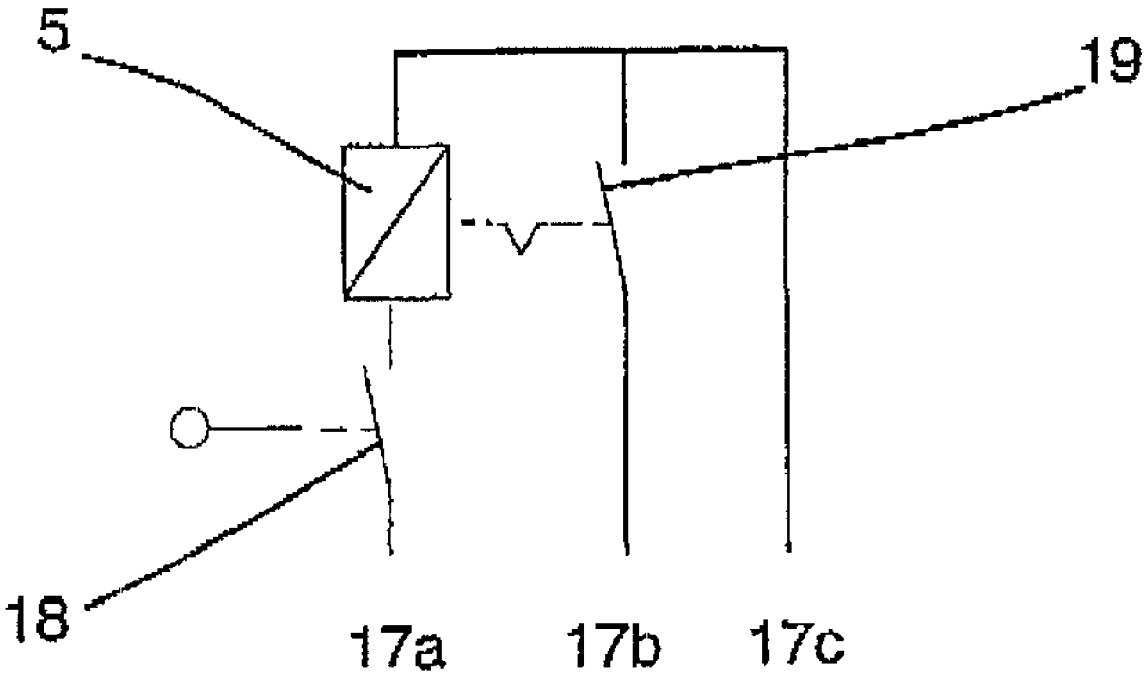
FIG. 9 shows a circuit arrangement for the electrical connection of the lock from FIG. 7.

According to a further illustrative embodiment represented in FIGS. 7 and 8, the electrical connection for the voltage supply for the lock 1 and the door contact can be simplified accordingly. A three-pole electrical connection 17 is then sufficient. Here, the electric switch 18 serving as a door contact is connected in series with a connection 17*a* for the supply voltage of the electromagnet 5, as can be recognized with reference to the circuit diagram in FIG. 9. The other connection 17*c* for the voltage supply is connected directly to the electromagnet 5. If the door is in the closed setting, then the electric switch 18 is on, whereby the supply voltage is present at the electromagnet 5 for the actuation thereof. It is immediately apparent that, consequently, a change in the state of the locking mechanism 4 is possible only when the door is closed. In this case, the machine control system in the household appliance can then, by means of an auxiliary contact 19, via the further electrical connection 17*b*, actuate the electromagnet 5 to bring the locking mechanism 4 into the desired state. Since only the three poles corresponding to the electrical connections 17*a*, 17*b*, 17*c* are required in this case, a simpler electrical connection 17 is obtained than in traditional locks.

The invention is not limited to the illustrative embodiments which have been described and represented. Rather, it also embraces all expert refinements within the scope of the invention defined by the patent claims. Such a lock 1 can thus be used not only in household appliances, but also in other machines provided with a closing element, in particular where installation spaces are cramped. Due to the high reliability of the lock 1 according to the invention, furthermore, deployment in motor vehicles, real estate or the like is also possible.

REFERENCE SYMBOL LIST

1: lock
2: housing
3: retaining element
4: locking mechanism
5: electromagnet
6: blocking element
7: permanent magnet
8: rocker element
9: push rod
10: connecting link
10*a, b*: connecting link part
11: switching element
12, 12': emergency unlocking lever
13: blocking surface
14: spring
15: compression spring
16: recess (in retaining element)
17, 17*a*, 17*b*, 17*c*: electrical connection
18: electric switch (door contact)
19: auxiliary contact
20: door
21: household appliance
22: locking bar

We claim:

1. A lock for a household appliance, the lock comprising:

a movable retaining element for interaction with a locking bar located on a closing element of the household appliance, the retaining element being movable a distance along a path of movement; and a two-state locking mechanism for the retaining element, the locking mechanism comprising a pivotable blocking element including a cylindrical portion, a blocking surface located at a first end of the cylindrical portion, and a rocker element located at a second end opposite the first end, the rocker element being connected to and separated from the blocking surface by the cylindrical portion, the blocking surface being pivotable between a first state into the path of movement and a second state out of the path of movement, in the first state, the blocking surface engages with the retaining element to block the movement of the retaining element along the path of movement, and in the second state, the blocking surface is free from engagement with the retaining element allowing the retaining element to move freely along the distance, wherein the locking mechanism is electromagnetically controlled between the first state and the second state, the electromagnetic control of the locking mechanism being an electrically energizable coil in the style of an electromagnet and wherein the rocker element has a first and second setting and is operatively connected to the electromagnet, the operative connection being established by means of a push rod movable by the electromagnet, the push rod engaging for moving purposes between first and second settings in a connecting link on the rocker element wherein when the rocker element is in the first setting the blocking surface is in the first state and when the rocker element is in the second setting the blocking surface is in the second state.

2. The lock as claimed in claim 1, wherein the movable retaining element is a slider having a recess.

3. The lock as claimed in claim 1, wherein the connecting link is configured in an approximately W-shape.

4. The lock as claimed in claim 1, further comprising a switching element operatively connected to at least one of the retaining element and the locking mechanism, the switching element generating switching signals as a function of a setting of at least one of the retaining element and the locking mechanism.

5. The lock as claimed in claim 1, wherein the closing element is movable between a closed setting and an open setting, and wherein, an electric switch, serving as a door contact interacts with the closing element to provide a signal indicating that the closing element is in one of the closed and the open setting.

6. The lock as claimed in claim 5, wherein the electric switch is disposed on the body of the household appliance.

7. The lock as claimed in claim 5, wherein the electric switch is connected in series with a connection for a supply voltage of the electrically energizable coil, the electric switch being on whenever the closing element is in the closed setting, such that the supply voltage is present at the coil for the actuation thereof.

8. The lock as claimed in claim 7, wherein the coil is actuated by means of an auxiliary contact.

9. The lock as claimed in claim 1, wherein the closing element is one of a door, a lid and a hinged opening.

10. A lock for a household appliance, the lock comprising:

a movable retaining element for interaction with a locking bar located on a closing element of the household appliance, the retaining element being movable a distance along a path of movement; and a two-state locking mechanism for the retaining element, the locking mechanism comprising a pivotable blocking element including a cylindrical portion, a blocking surface located at a first end of the cylindrical portion, and a rocker element located at a second end opposite the first end, the blocking surface being pivotable between a first state into the path of movement and a second state out of the path of movement, in the first state, the blocking surface engages with the retaining element to block the movement of the retaining element along the path of movement, and in the second state, the blocking surface is free from engagement with the retaining element allowing the retaining element to move freely along the distance, wherein the locking mechanism is electromagnetically controlled between the first state and the second state, the electromagnetic control of the locking mechanism being an electrically energizable coil in the style of an electromagnet wherein the rocker element has a first and second setting and is operatively connected to the electromagnet, the operative connection being established by means of a push rod movable by the electromagnet, the push rod engaging for movable purposes between first and second settings in a connecting link on the rocker element wherein when the rocker element is in the first setting the blocking surface is in the first state and when the rocker element is in the second setting the blocking surface is in the second state.

11. The lock as claimed in claim 10, wherein the movable retaining element is a slider having a recess.

12. The lock as claimed in claim 10, wherein the connecting link is configured in an approximately W-shape.

13. The lock as claimed in claim 10, further comprising a switching element operatively connected to at least one of the retaining element and the locking mechanism, the switching element generating switching signals as a function of a setting of at least one of the retaining element and the locking mechanism.

14. The lock as claimed in claim 10, wherein the closing element is movable between a closed setting and an open setting, and wherein, an electric switch, serving as a door contact interacts with the closing element to provide a signal indicating that the closing element is in one of the closed and the open setting.

15. The lock as claimed in claim 14, wherein the electric switch is disposed on the body of the household appliance.

16. The lock as claimed in claim 14, wherein the electric switch is connected in series with a connection for a supply voltage of the electrically energizable coil, the electric switch being on whenever the closing element is in the closed setting, such that the supply voltage is present at the coil for the actuation thereof.

17. The lock as claimed in claim 16, wherein the coil is actuated by means of an auxiliary contact.

18. The lock as claimed in claim 10, wherein the closing element is one of a door, a lid and a hinged opening.

* * * * *